United States Patent [19]

Reim

[11] Patent Number: 4,516,342

[45] Date of Patent: May 14, 1985

[54] ARRANGEMENT FOR EXCHANGEABLY FRAMING PICTURES

[76] Inventor: Paul Reim, Rathausgasse 5, D-7100 Heilbronn, Fed. Rep. of Germany

[21] Appl. No.: 507,126

[22] Filed: Jun. 23, 1983

[30] Foreign Application Priority Data

Jun. 23, 1982 [DE] Fed. Rep. of Germany ..... 3223416

[51] Int. Cl.[3] ..... A47G 1/06

[52] U.S. Cl. ..... 40/156; 40/13; 40/16.6; 40/157

[58] Field of Search ..... 40/16.6, 13, 156, 157; 248/488, 490; 52/716, 717

[56] References Cited

FOREIGN PATENT DOCUMENTS 1536121 12/1978 United Kingdom ..... 40/156

2057870 4/1981 United Kingdom ..... 40/156

*Primary Examiner*—Gene Mancene

*Assistant Examiner*—Cary E. Stone

*Attorney, Agent, or Firm*—Michael J. Striker

[57] ABSTRACT

An arrangement for exchangeably framing pictures includes a frame which has a profile cross section and a hook-shaped end portion and is arranged to hold a cover plate and a rearward plate which confine a picture therebetween. The frame cooperates with a resilient locking member which includes one portion arranged to rest against the rearward plate and another portion provided with a hook-shaped end which defines a groove. The hook-shaped end portion of the frame is engageable in the groove of the locking member so that the support face of the hook-shaped end of the locking member abuts against the hook-shaped end portion of the frame. The locking member is kept in its position and securely clamps the frame regardless of whether or not anchoring with a rivet located in the rearward plate is provided.

21 Claims, 4 Drawing Figures

ARRANGEMENT FOR EXCHANGEABLY FRAMING PICTURES

BACKGROUND OF THE INVENTION

The invention relates to an arrangement for exchangeably framing pictures.

There are known arrangements for exchangeably framing pictures made of metal and plastic which arrangements are closed in such a manner that locking parts are fixed pivotable and slidable wherein the locking parts are clamped in a circumferential profile frame. Through the provision of such an anchoring of the rearward plate and profile frame, an essential stabilization is obtained, and it is prevented that the profile frame is bent aside from the rearward plate at a respective load. The cover plate together with the rearward plate cannot slip out from the frame upon carrying or suspending of a profiled frame side. When exchange frames for pictures covering a large area are concerned, this arrangement is advantageous especially when the locking parts serve as suspension of the picture because the weight can be carried by the rearward plate.

This arrangement has, however, the disadvantage that the locking parts must be permanently fixed to the rearward plate, which is cumbersome and requires substantial work when considering that upon using exchange frames for smaller pictures the permanent fixation is completely superfluous because an anchoring of the profiled frame to the rearward plate is not necessary. The profile frame is sufficiently dimensioned to provide the carrying upon suspension because of the lower weight of the arrangement. An especial stabilization problem cannot occur.

There are also arrangements for exchangeably framing pictures which are locked by loose locking parts at the rear portion. These loose locking parts are consequently not fixed to the rearward plate by rivet joint or the like so that they are suitable to be used for smaller picture sizes and they inherit the advantage that a fixation to the rearward plate is avoided. On the other hand, if picture sizes of large format are concerned, these exchange frames for pictures are insufficient since they lack the advantage of anchored locking parts fixed to the rearward plate. Moreover, the use of such loose locking parts is disadvantageous because of the fact that both ends must be engaged in the profiled frame. Upon disengagement through depressing, the locking parts must additionally be tilted or pivoted in order to loosen both ends from the profiled frame.

SUMMARY OF THE INVENTION

It is, therefore, the object of the present invention to avoid the disadvantages of the prior art.

More particularly, it is an object of the present invention to provide an arrangement for exchangeably framing pictures which does not necessitate an anchoring of the locking parts to the rear wall when using pictures of small size and which simultaneously provides an anchoring to the profile frame and rearward plate in case pictures of large size are used.

Yet another feature of the invention is to provide an arrangement for exchangeably framing pictures in which the locking parts can easily be engaged or disengaged without necessitating a pivoting or tilting thereof.

A concomitant object of the present invention is to provide an arrangement for exchangeably framing pictures which is simple in construction ,reliable in operation and inexpensive nevertheless.

In keeping with these objects and with others which will become apparent hereinafter, one feature of the invention resides in an arrangement for exchangeably framing pictures, comprising a frame having a profiled cross section and a hook-shaped end portion and arranged to hold a cover plate and a rearward plate confining a picture therebetween; and a resilient locking member including one portion arranged to rest against the rearward plate and another portion provided with a hook-shaped end which defines a groove and has a support face, the hook-shaped end portion of the frame being engageable in the groove of the locking member in such a manner that the support face of the hook-shaped end of the locking member abuts against the hook-shaped end portion of the frame.

According to a first embodiment, the one portion of the locking member is a support plate having a peripheral edge, the support plate being provided with a plurality of longitudinal slots which extend towards the peripheral edge of the support plate so as to form a plurality of resilient tongues, said plurality of slots including a center slot which converges in direction towards the peripheral edge.

The rearward plate is provided with a rivet which cooperates with the center slot so that upon pushing the locking member over the rivet, the resilient tongues spread at the center slot to such a manner that the locking member is clamped and retained. The support plate abuts in a plan manner on the rearward plate. The other portion of the locking member is a resilient shank which has one end angularly connected to the support plate and another end which is constituted by a hook-shaped end. Upon pushing in the locking clamp, the resilient shank thereof is tensioned while the hook-shaped end is in engagement with the hook-shaped end portion of the frame.

According to another embodiment of the present invention, the one portion of the locking member is a support plate having a peripheral edge, wherein the support plate defines a longitudinal recess which extends towards and converges in direction to the peripheral edge of the support plate in such a manner that the resilient V-shaped snap opening is provided. The other portion of the locking member is a resilient shank which has one end angularly connected to the support plate so as to provide a bent transition. In the area of the bent transition, an expansion opening is provided which is in connection with a longitudinal gap leading to the recess at its end remote to the snap opening. Through the provision of such an extension opening, the snap opening is spreadable and renders possible the engagement over the rivet which is provided in the rearward plate. The width of the recess corresponds to the shank diameter of the rivet with a minus tolerance in the forward part and a surplus tolerance in the rearward part. Through this tolerance difference, the locking clamp will become slightly clamped when the profile frame is disengaged. Consequently, the locking clamp is maintaining its position.

When using exchange frames for pictures of large format, the recess as well as the center slot of the locking clamp is slidably engaged with the rivet fixed to the rearward plate. The distance of the rivet from the rearward plate is dimensioned so that the locking clamp can be slid only to such an extent in direction to the profile frame that the groove of the locking frame is still in engagement with the hook-shaped end portion of the frame, so that the profile frame is anchored with the rearward plate. The head of the rivet is spaced from the rearward plate by such a distance that the locking member is slidable to and fro in longitudinal direction of the center slot as in the first embodiment or of the recess as in the second embodiment. The support plate as provided in the second embodiment is slightly bent and rests on the rearward plate.

Through the feature that the support face of the hook-shaped end of the locking member abuts against the hook-shaped end portion of the frame, it is achieved that the locking member or locking clamp is kept in its position regardless of whether the locking member is slidably engaged or anchored with the rivet as arranged in the rearward plate. Consequently, the locking member performs a dual function and can be used with lighter and smaller sized pictures without being anchored and with larger sized pictures under which circumstances an anchoring is obtained.

The locking member is easy to handle when releasing the anchoring. It is sufficient to depress the locking member in the area of its suspension eye in order to release the clamping. In equal manner, the insertion of the locking member is easy to perform and is facilitated by the fact that the locking member engages in the profile frame only with a single part. There is no difference in handling the locking member when being anchored or when being in an unanchored state. It is also possible to anchor a part of the locking member to the rearward plate of a exchange frame for pictures and to leave another part not anchored. An unintentional release of the locking member is impossible regardless of whether thick or thin pictures are used.

Each locking member has a punched-out suspension eye in the area of the resilient shank in order to suspend the frame on a wall hook.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
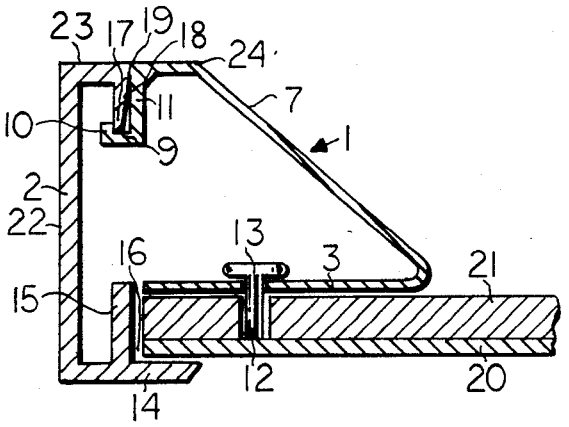
FIG. 1 shows a cross-sectional view of a profiled frame in engagement with a locking member according to a first embodiment of the invention wherein the locking member is slidably anchored at a rearward plate by means of a rivet.

Referring firstly to FIG. 1, there is shown the cross section of a profile frame 2 which consists of profile strips rectangularly connected to each other in the respective miterings. The profiled frame 2 has a profile upper part 14 which is integrally connected with an external profile surface 22 and extending perpendicularly thereto. The profile upper part 14 is provided with a limiting web 15 which extends perpendicularly in inward direction from the profile upper part 14 so as to be parallel to the external surface 22 and to form together with the upper part a receiving space 16. Consequently, a cover plate 20 and a rear plate 21 which confine a picture therein can be precisely fitted into the receiving space 16 and thereby onto the exchange frame for pictures. Connected to one end of the external profile surface 22 is a hook-shaped end portion which is provided with a rear web 23 extending perpendicularly to the external surface 22 and parallel to the profile upper part 14 and a wedge bar 18 which extends perpendicularly in inward direction from the wedge bar 23 so as to be parallel to the external surface 22 as well. The wedge bar 18 and the limiting web 15 are spaced by equal distances from the external surface 22 wherein the length of the rear web 23 is determined by the distance of the wedge bar 18 from the external surface 22.

Figure 2:
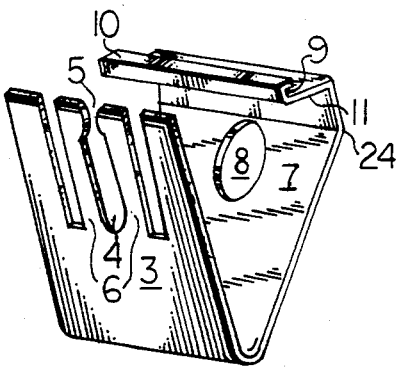
FIG. 2 is a perspective illustration of the locking member according to FIG. 1.

In FIG. 1, there is shown a locking clamp according to a first embodiment which is generally characterized by reference numeral 1. The locking clamp 1 has a lower part provided with a support plate 3 which is in plane contact with the rearward plate 21. Referring especially to FIG. 2, there is illustrated that the support plate 3 is provided with a plurality of slots which extend towards the peripheral edge of the support plate 3 so as to define a plurality of resilient tongues 6. As can be seen from FIG. 2, two resilient tongues 6 define a center slot 4 which converges in direction towards the peripheral edge in order to provide a narrowing slot opening 5. The opening 5 is slightly narrow than the diameter of a rivet 12 which is provided at the rearward plate 21 wherein the center slot 4 has a width corresponding to the diameter of the rivet 12 with a surplus tolerence. The rivet 12 is provided with a rivet head 13 which is spaced from the rearward plate 12 by such a distance that the locking member 1 is slidable to and fro in longitudinal direction of the center slot 4 when engaging the rivet 12 into the slot 4. This can be easily done by slight pressure so that the resilient tongue 6 yields when pushing the locking member 1 over the rivet 12.

Connected to the support plate 13 at an acute angle is a resilient shank 7 which is provided with a hook-shaped end via a bent portion 24. The hook-shaped end of the resilient shank 7 includes a support face 11 and a tab portion 10 so as to define a groove 9. The groove 9 is in engagement with a tip 17 of the wedge bar 18, wherein the support face 11 simultaneously abuts against an end face 19 of the wedge bar 18.

The locking clamp 1 is thus kept in its desired position regardless of whether or not the rivet 12 is anchorged with the rearward plate 21. The rivit 12 is located at such a distance from the outer edge of the rearward plate 21 that the engaged locking member is slidable towards the frame to such an extent that the groove 9 is still engaged with the tip 17 of the wedge bar 18 thereby providing an anchoring of the rearward plate 21 and the profile frame 2.

Figure 3:
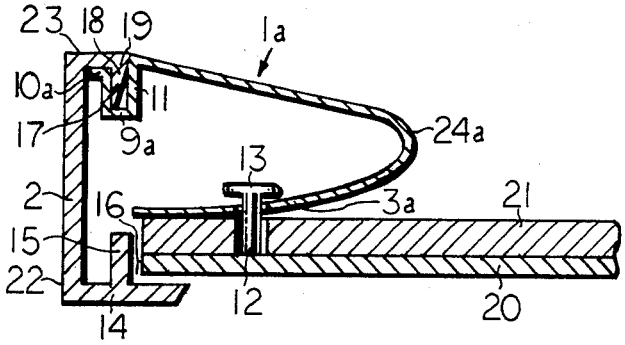
FIG. 3 shows a cross section of the profile frame in engagement with a locking member according to a second embodiment of the present invention, wherein the locking member is slidably anchored at the rearward plate by means of the rivet.
Figure 4:
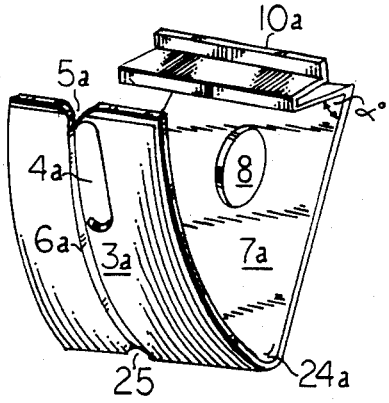
FIG. 4 is a perspective illustration of the locking member according to FIG. 3.

Turning now to the embodiment as illustrated in FIGS. 3 and 4, it may be noted that like parts as shown in FIGS. 1 and 2 are characterized by the same reference numerals.

The profile frame 2 includes the profile upper part 14, the external profile surface 22, the limiting web 15 for supporting the cover plate 20, the rearward plate 21 and the picture confined therebetween.

Turning now to FIG. 4, there is shown a locking clamp 1*a* which is provided at its lower portion with a slightly bent support plate 3*a* for contact with the rearward plate 21. In the center of the support plate 3*a*, a longitudinal recess 4*a* is provided which extends towards and coverges in direction to the peripheral edge of the support plate 3*a* in such a manner that a resilient V-shaped snap opening 5*a* is obtained. The snap opening 5*a* is narrower than the diameter of the rivet 12 as provided in the rearward plate 21.

Connected with the support plate 3*a* via a bent transition 24*a* is a resilient shank 7*a* which is provided remote to the bent transition 24*a* with a hook-shaped end. The hook-shaped end includes a support surfaces 11 and a tab 10*a* so as to define a groove 9*a*. In contrast to the first embodiment, the tab 10*a* is of inverted L-shape, so that one portion thereof is parallel to the rear web 23. The groove 9 surrounds the tip 17 of the wedge bar 18 wherein simultaneously the support face 11 abuts against the end face 19 of the wedge bar 18. As can be further seen from FIG. 4 an expansion opening 25 is provided in the area of the bent transition, which opening is connected to the recess 4*a* via a longitudinally extending gap 6*a*.

As described with respect to the first embodiment, the rivet 12 can easily be brought into engagement with the recess 4*a* by applying a light pressure.

The recess 4*a* has a width essentially corresponding to the diameter of the rivet with a minus tolerance at the forward part thereof and a surplus tolerance at the rearward part thereof.

As can be further seen from FIGS. 3 and 4, the support surface 11 is arranged at an angle of approximately 80° to the resilient shank 7*a*.

Also in this embodiment, it is guaranteed that the locking clamp is kept in its desired position with respect to the profiled upper part 14 regardless of whether or not anchoring with the rearward plate 21 is obtained by means of the rivet 12.

In both embodiments of the present invention, the resilient shank is provided with an suspension eye 8 for providing the possibility to suspend the frame at a not shown wall hook.

It will be understood that each of the elements described above, or two or more together, may also find a useful application in other types of arrangements for exchangeably framing pictures differing from the types described above.

While the invention has been illustrated and described as embodied in an arrangement for exchangeably framing pictures, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An arrangement for exchangeably framing pictures, comprising: a frame having a profiled cross section and a hook-shaped end portion and arranged to hold a cover plate and a rearward plate confining a picture therebetween; and a resilient locking member including one portion arranged to rest against the rearward plate and another portion provided with a hook-shaped end which defines a groove and has a support face, the hook-shaped end portion of the frame being engageable in the groove of the locking member in such a manner that the support face of the hook-shaped end of the locking member abuts against the hook-shaped end portion of the frame, the frame having a profile upper part and an external profile surface the one end of which is integrally connected with the hook-shaped end portion and the other end of which is entegrally connected with the profile upper part extending perpendicularly to the external surface so that the frame is of essentially C-shaped cross section, the hook-shaped end portion having one part extending perpendicularly to the external surface and parallel to the profile upper part and another part extending perpendicularly in inward direction from the one part so as to be parallel to the external surface, said another part being wedge shaped to form a wedge bar which is engageable with the groove.

2. An arrangement as defined in claim 1, wherein the profile upper part is provided with a limiting web extending perpendicularly in inward direction so as to be parallel to the external surface and to support the cover plate, the rearward plate and the picture.

3. An arrangement as defined in claim 2, wherein the wedge bar and the limiting web are spaced by equal distances from the external surface.

4. An arrangement as defined in claim 1, wherein the locking member is a locking clamp.

5. An arrangement as defined in claim 1, wherein the rearward plate has an outer edge and is provided with a rivet, the rivet being located at such a distance from the outer edge that the locking member is slidable towards the frame to an extent that the hook-shaped end is still engageable with the hook-shaped end portion of the frame.

6. An arrangement as defined in claim 1, wherein the other portion of the locking member is formed so as to serve as a suspension eye.

7. An arrangement for exchangeably framing pictures, comprising: a frame having a profiled cross section and a hook-shaped end portion and arranged to hold a cover plate and a rearward plate confining a picture therebetween; and a resilient locking member including one portion arranged to rest against the rearward plate and another portion provided with a hook-shaped end which defines a groove and has a support face, the hook-shaped end portion of the frame being engageable in the groove of the locking member in such a manner that the support face of the hook-shaped end of the locking member abuts against the hook-shaped end portion of the frame, the one portion of the locking member being a support plate having a peripheral edge, the support plate being provided with a plurality of longitudinal slots which extend towards the peripheral edge of the support plate so as to form a plurality of resilient tongues, said plurality of slots including a center slot which converges in direction towards the peripheral edge.

8. An arrangement as defined in claim 7, wherein said another portion of the locking member is a resilient shank having one end angularly connected to the support plate and another end constituted by the hook-shaped end.

9. An arrangement as defined in claim 7, wherein the rearward plate is provided with a rivet having a predetermined diameter, the rivet being engageable with the center slot.

10. An arrangement as defined in claim 9, wherein the rivet has a rivet head spaced by such a distance from the rearward plate that the locking member is slidable to and fro in longitudinal direction of the center slot.

11. An arrangement as defined in claim 10, wherein the center slot has a width corresponding to the diameter of the rivet with a surplus tolerance.

12. An arrangement as defined in claim 7, wherein the resilient tongues are formed so that they yield when pushing the locking member over the rivet so that the locking member is clamped and retained against the rearward plate.

13. An arrangement as defined in claim 7, wherein the support plate is slightly bent.

14. An arrangement as defined in claim 13, wherein said another portion of the locking member is a resilient shank having one end angularly connected to the support plate so as to provide a bent transition, and another end being constituted by the hook-shaped end.

15. An arrangement as defined in claim 14, wherein the recess is connected to a longitudinal gap at its end remote to the snap opening, the gap leading to an expansion opening being provided in the area of the bent transition.

16. An arrangement for exchangeably framing pictures, comprising: a frame having a profiled cross section and a hook-shaped end portion and arranged to hold a cover plate and a rearward plate confining a picture therebetween; and a resilient locking member including one portion arranged to rest against the rearward plate and another portion provided with a hook-shaped end which defines a groove and has a support face, the hook-shaped end portion of the frame being engageable in the groove of the locking member in such a manner that the support face of the hook-shaped end of the locking member abuts against the hook-shaped end portion of the frame, the one portion of the locking member being a support plate having a peripheral edge, the support plate defining a longitudinal recess which extends towards and converges in direction to the peripheral edge of the support plate in such a manner that a resilient V-shaped snap opening is provided.

17. An arrangement as defined in claim 16, wherein the rearward plate is provided with a rivet having a diameter, the recess being engageable with the rivet.

18. An arrangement as defined in claim 17, wherein the recess includes a forward part and a rearward part, the recess having a width corresponding to the diameter of the rivet with a minus tolerance at the forward part and a surplus tolerance at the rearward part.

19. An arrangement as defined in claim 17, wherein the one portion of the locking member is formed so that the snap opening expands when pushing the locking member under the rivet so that the locking member is clamped and prevented from unintentional release.

20. An arrangement as defined in claim 17, wherein the rivet has a rivet head spaced by such a distance from the rearward plate that the locking member is slidable to and fro in longitudinal direction of the recess.

21. An arrangement as defined in claim 16, wherein the hook-shaped end of the other portion of the locking member is arranged at an angle of approximately 80° with respect to the other portion.

* * * * *